United States Patent [19]

Madl et al.

[11] 4,035,913

[45] July 19, 1977

[54] DEVICE FOR FORMING TRIM PATTERNS IN FUR

[76] Inventors: Josef Madl, Langbehnstrasse 20, D-82 Rosenheim; Hans Schober, Hochriesstrasse 25, D-82 Rosenheim-Heiligblut, both of Germany

[21] Appl. No.: 598,435

[22] Filed: July 23, 1975

[30] Foreign Application Priority Data

| | | |
|---|---|---|
| Aug. 5, 1974 | Germany | 2437694 |
| Oct. 30, 1974 | Germany | 2451528 |

[51] Int. Cl.[2] ..... B26B 29/00

[52] U.S. Cl. ..... 30/287; 30/304

[58] Field of Search ..... 30/287, 304, 305

[56] References Cited

U.S. PATENT DOCUMENTS

| | | | |
|---|---|---|---|
| 704,867 | 7/1902 | Dews | 30/304 UX |
| 833,480 | 10/1906 | Nutter | 30/287 UX |
| 1,825,108 | 9/1931 | Webster | 30/287 |
| 1,999,972 | 4/1935 | Becker | 30/305 UX |
| 2,197,650 | 4/1940 | Piper et al. | 30/304 |
| 2,464,206 | 3/1949 | Becker | 30/339 X |

FOREIGN PATENT DOCUMENTS

| | | | |
|---|---|---|---|
| 863,760 | 1/1941 | France | 30/299 |
| 907,211 | 3/1954 | Germany | 30/299 |
| 189,960 | 12/1922 | United Kingdom | 30/304 |

*Primary Examiner*—Gary L. Smith
*Assistant Examiner*—J. T. Zatarga
*Attorney, Agent, or Firm*—Orrin M. Haugen

[57] ABSTRACT

The invention concerns a device for trim patterning furs with a group of knife blades, arranged at equal intervals next to each other and aligned parallel to each other, whose cuts run acute-angled to the leather back side of the material surface, with a convex slot plate opposite the material surface displaying a pass-through slot for each knife blade, and with an adjustment arrangement for establishing a desired projecting length for the knife blades above the convex side of the slot plate.

10 Claims, 8 Drawing Figures

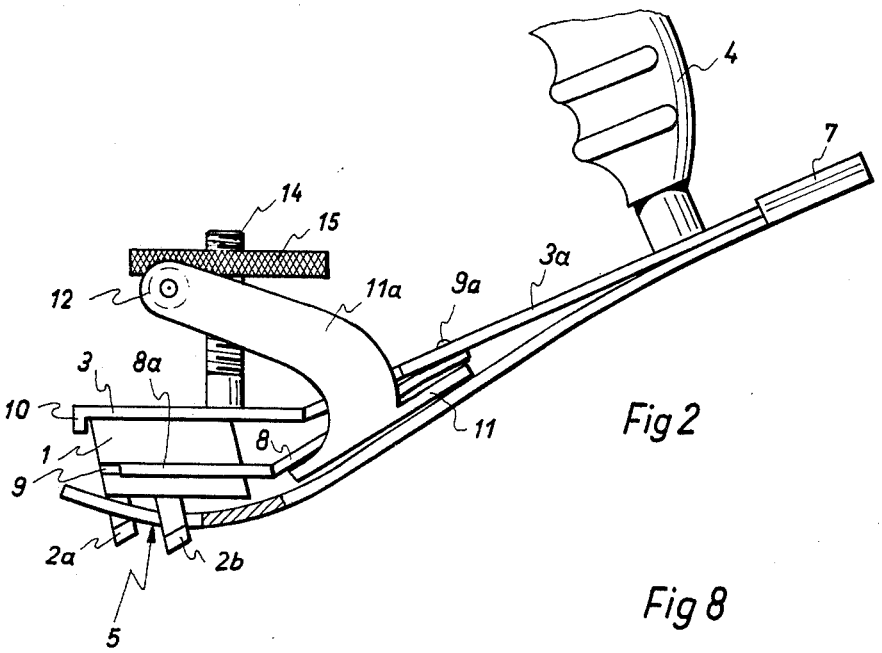
Fig 2
Fig 3
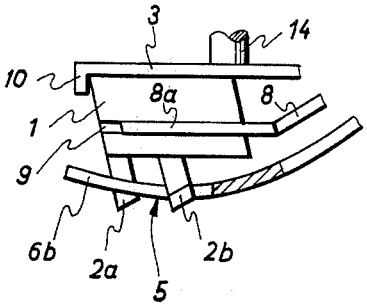
Fig 8
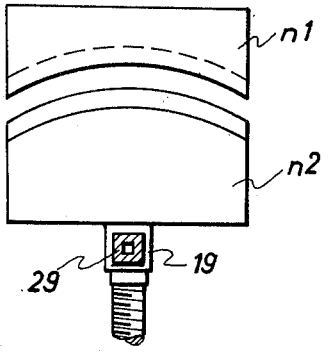
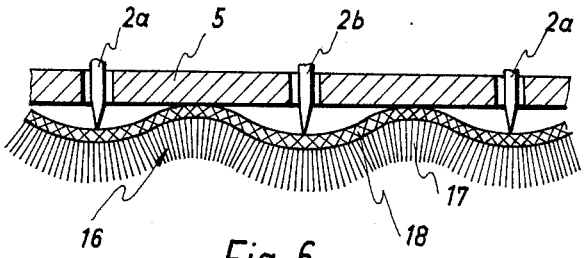
Fig 6

DEVICE FOR FORMING TRIM PATTERNS IN FUR

BACKGROUND OF THE INVENTION

Already known from French Pat. No. 863,760, is a device of the type mentioned which is intended for fixed installation and displaying polygon or star-shaped knives supported on a shaft, with puncturing blades distributed evenly over the circumference, wherein the blade group is adjustable in height relative to the fixed slot plate by means of two vertical threaded spindles arranged at either side of the slot plate. With this, however, after each adjustment in height of the blade group, the parallelism between the blade group and slot plate must again be re-established because the settings of both threaded spindles are synchronized to each other. This represents a time consuming process such that the device, as is already apparent from its fixed construction, is more aptly suited to processing plants that process larger lots of similar type fur. Moreover, the known type device is more aptly suited for cutting up furs into parallel strips, less favorable, however, for introducing trim patterning slits because, with rotating polygon or star-shaped knife blades only puncture cuts are possible which, perforce, lead to damaging of the thick underlying wool and whereby whole tufts of hair can fall out. Nor can this be prevented by any precise determination of a desired projecting length for the knife blades above the convex side of the slot plate.

Lightweight devices, in the form of manually operated tools for cutting up a fur into parallel strips, are already known from German Pat. No. 907,211. One such kind of tool includes a group of circular knife blades whose positioning in height is adjustable relative to a front and rear holddown roller for the back side of the fur, and which are parallel to the group of knife blades. However, a tool of this type is not suitable for trim patterning, even if we were to substitute for the circular knife blades, knife blades that are polygon or star-shaped, somewhat like the kind in French Pat. No. 863,760, since, in this manner, only puncture cuts could, perforce, be generated.

Known from U.S. Pat. No. 2,464,206 is a device in the form of a manually operated tool that includes a group of draw-knife blades arranged at equal intervals next to each other and aligned parallel to each other, along with a handle, so that, when trim patterning, several series of cuts can be made simultaneously in the back side of the fur. The depth of penetration of the knife when working with the tool is, however, not established by the device and depends solely upon the handling by the operator so that guidance of the tool, similarly as in the case of the likewise known trim patterning knife with only one knife blade, requires considerable experience in order to execute trouble-free draw cuts without damaging the underlying wool of the fur.

SUMMARY OF THE INVENTION

The task set forth for the invention is to obtain a device that is in the form of a light weight hand operated tool suitable for carrying out draw cuts for trim patterning furs, with which it is possible to obtain a parallelism between the groups of knife blades and the slot plate without the need for a two-side adjustment and, thereby, a rapid conversion for trim patterning of different kinds of furs. This is achieved in that the knife blades that are structured, in a manner known per se, as draw-knife blades are arranged on a mounting plate provided with a hand grip, that the slot plate is firmly attached, at an extension piece turned away from the draw-knife blades, to a corresponding extension piece of the mounting plate, and that the spread interval between the free, draw-knife side sections of the mounting and slot plates is adjustable through means of the positioning arrangement.

By joining the extension piece of the slot plate to the corresponding extension piece of the mounting plate, an automatic parallel guidance of both plates, at any spread interval, is achieved and, along with this, also the desired parallelism between the straight lines joining the tips of the knife blades, relative to the surface of the slot plate. This also makes possible an overall simple and weight saving construction of the tool.

DESCRIPTION OF THE DRAWINGS

The invention is explained in more detail in the following and with reference to the sketches. They show:

FIG. 2, the same tool as in FIG. 1 in the same representation, where, however, the draw-knives are positioned at the maximum depth of penetration in the material surface;

FIG. 3, the tool of FIGS. 1 and 2 in the same representation, in partial view, however, where the draw-knife blades are set at an optimum depth of penetration in the material surface;

FIG. 6, the working method of the draw-knives contained in the device that is in accord with FIGS. 1–5 on the surface of the work piece, in a representation that is greatly enlarged relative to FIGS. 1–5, corresponding somewhat to a view along line VI—VI of FIG. 4;

FIG. 8, a cut along line VIII—VIII of FIG. 7.

DESCRIPTION OF THE PREFERRED EMBODIMENT

Figure 1:
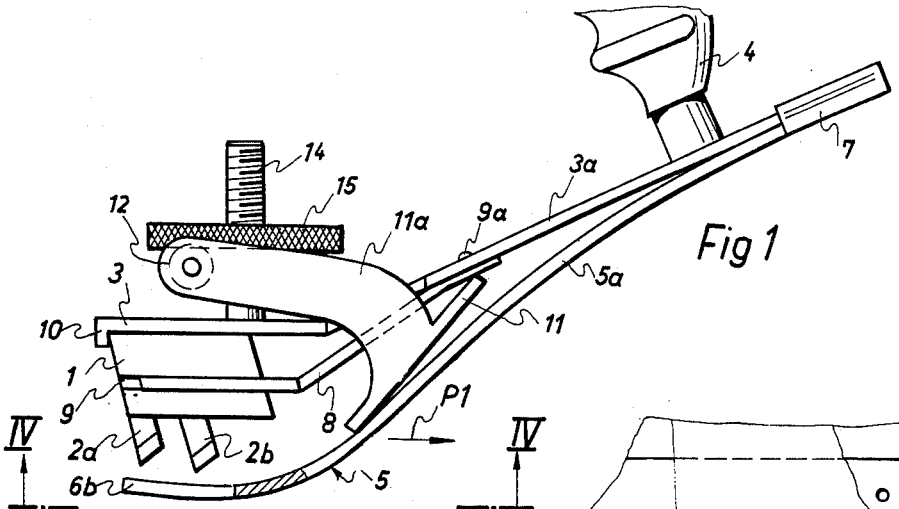
FIG. 1 an example of embodiment of a device in accordance with the invention, structured as a work tool, in a side view as well as in a partially broken out representation, where a number of the draw-knives contained within the tool are brought out into a non-operating position.
Figure 4:
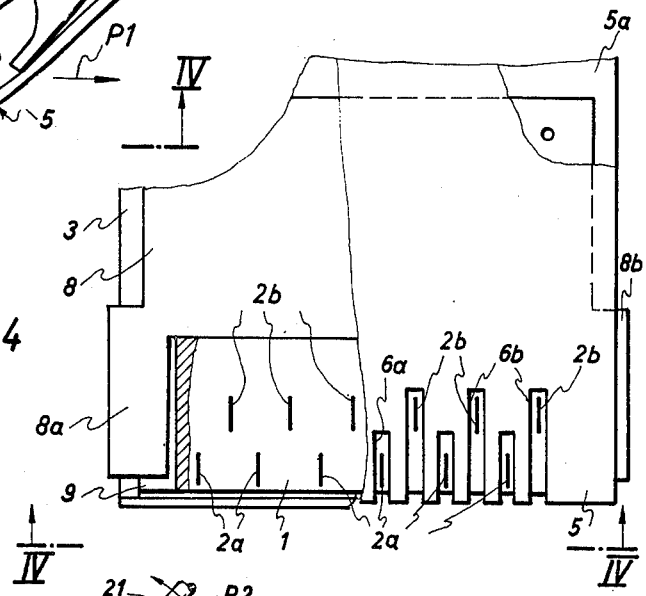
FIG. 4, a view along the line IV—IV of FIG. 1 but in greatly magnified, broken partial representation.

The tool illustrated in FIGS. 1–5 includes a cutter-holder support 1 for a number of draw-knife blades *2a*, *2b*, where, in the side views in accordance with FIGS. 1–3, only one each of several draw-knife blades *2a* and one each of several draw-knife blades *2b* are illustrated. The draw-knife blades *2a* on the one hand, and *2b* on the other hand, are, as illustrated, arranged in two rows of knives located one behind the other and extending perpendicularly to the direction of drawing (corresponding to the direction of an arrow P 1 of FIG. 1). Within each row of knives, the draw-knife blades *2a* and/or *2b* display the same interval next to each other and are anchored within cutter-holder support 1 in a parallel orientation, as is best seen from FIG. 1. The two rows of draw-knives *2a*, *2b* display a sideward offset to each other corresponding to one-half the interval of two draw-knives *2a* and/or *2b* within each row of knives, which is, likewise, best obtained from FIG. 4. The interval between the two rows of knives of draw-knives 2*a*, 2*b* is, in the direction of drawing (arrow P 1 of FIG. 1), relative to the blade tips, is approximately half as great as the length of the trim patterning slits which are to be made in the surface of a material.

The cutter-holder support 1 displays a shape approaching that of a square building block, in the present example the shape of a parallelepipedon, and lies against a mounting plate 3. The mounting plate 3 displays an extension piece 3*a* that is turned away from the cutter-holder support 1, on which is mounted a hand grip 4 running approximately perpendicularly to the surface of the extension.

Associated with both rows of knives, the rows being made up of draw-knife blades 2*a*, 2*b*, and running perpendicularly to the planes of the knives as well as base cutter-holder support 1, is a sole or slot plate 5 that is slightly arched convexly to the material (surface of the work) and to be brought into contact with the material surface. The width of plate 5 corresponds to at least the interval between the two outermost draw-knife blades 2*a*, 2*b* that are contained within the two rows of knives. Provided within sole plate 5 for each draw-knife blade 2*a*, 2*b* is an associated pass-through slot and, indeed, as can be best obtained from FIG. 4, in the form of comb-like cutouts 6*a*, 6*b*, wherein the cutouts 6*a* associated to draw-knife blades 2*a* are shorter than the cutouts 6*b* that are associated with the draw-knife blades 2*b*. On one end that is turned away from cutter-holder support 1, sole plate 5 displays an extension piece 5*a* that runs convergently to the corresponding extension piece of mounting plate 3, whereby the two extension pieces 3*a*, 5*a* are firmly joined at their contacting area and, indeed, in the case of the example of embodiment shown, through means of a pair of tabs 7, structured as a single piece with extension piece 5*a* of sole plate 5, and gripping about the extension piece 3*a* of mounting plate 3. The sole plate 5 along with its extension piece 5*a* are constructed to be springy and are biased against mounting plate 3.

Viewing from the direction of FIGS. 1 and 2, the sole plate 5 with its tabs 7 is pushed on from right to left onto the extension piece 3*a* of mounting plate 3. In order to obtain a firmly seated but simultaneously removable and replaceable connection, extension piece 3*a* of the mounting plate is structured toward the end, in the area of tabs 7, to be somewhat tapered so that there results a wedge type meshing between the two extension pieces 3*a*, 5*a*. This makes possible the use of sole plates 5, having different intervals and cutouts 6*a*, 6*b*, in conjunction with associated, replaceable cutter-holder supports 1, so that the intervals between the trim patterning slits can be changed according to the type of fur to be processed.

In the region between cutter-holder support 1, as well as the contact area of the extension pieces 3*a*, 5*a* of mounting plate 3 and sole plate 5, respectively, a spring tongue 8 is fastened to the mounting plate 3 and/or its extension piece 3*a*, by means of pins 9*a* which, at its free end, is structured to accept cutter-holder support 1 and is tension biased against mounting plate 3. For this purpose, as can best be obtained from FIG. 4, the free end of spring tongue 8 is structured as a fork with two tines 8*a*, 8*b* which can be pushed, one each, into a side take-up slot 9 of cutter-holder support 1. The mounting plate 3 displays, in the direction opposite to that of drawing (arrow P 1 of FIG. 1), a stop 10 in the form of a bent-over corner for cutter-holder support 1 so that this latter is immovably lodged.

Between mounting plate 3 and/or its extension 3*a*, as well as between sole plate 5 and/or its extension 5*a*, in the area between the cutter-holder support as well as between the contact area of the extension pieces 3*a*, 5*a*, there is provided an adjustable spreader member 11 for establishing the mutually opposite interval of the mounting plate 3 and of sole plate 5. The spreader member 11 displays, to either side, an attached lever arm 11*a*, 11*b*, wherein these two lever arms are connected together at their free ends through a cross-bar 12. On the upper surface of mounting plate 3 that is turned away from cutter-holder support 1, there is an adjusting screw 14 extending vertically upwardly which accepts a knurled nut 15. The knurled nut 15, over a portion of its circumference, lies on cross-bar 12.

With the knurled nut turned all the way toward the top, as is obtained from FIG. 2, the sole plate 5 overcomes its pre-stress bias next to the mounting plate 3 so that the draw-knife blades 2*a*, 2*b* extend as far as possible past the lower surface of sole plate 5. If, in contrast to this, the knurled nut 15 is turned as far as possible toward the bottom, then a downwardly directed force is exerted on cross-bar 12 which causes an acuteangled swiveling of spreader member 11 relative to sole plate 5 and/or relative to the extension piece 3*a* of mounting plate 3, via lever arm 11*a*, 11*b*, wherewith sole plate 5 moves away relative to mounting plate 3 so that the draw-knife blades 2*a*, 2*b* can no longer extend through the comb-like cutouts 6*a*, 6*b* of sole plate 5. Normally, for the purpose of adapting to the material surface to be processed, an intermediate position is selected for knurled nut 15, in which position the sole plate 5 of mounting plate 3 displays a mid-interval, as is illustrated in FIG. 3, whereby the cutting edges of the draw-knife blades 2*a*, 2*b* extend at an acute-angle to the material surface and extend past the lower surface of sole plate 5 by some predetermined interval. The adjustment of knurled nut 15, as represented in FIG. 1, is done with the tool not operating in order to prevent damages as much as possible.

The depth of penetration of the draw-knife blades into the material surface to be processed is of special importance for the trim patterning process, where care is to be taken that in setting the tool down against the material surface to be processed, in the present case, therefore, sole plate 5, the leather back side is not penetrated. This correct adjustment position, which corresponds somewhat to that of FIG. 3, is represented with the aid of a fur 16 with fur tufts 17 and a layer of leather 18. The draw-knife blades 2*a*, 2*b* bow the layer of leather 18 and/or leather back side slightly downwardly while, between draw-knife blades 2*a*, 2*b* the back side of the leather lies against sole plate 5. Cutting into the layer of leather 18 occurs only with movement of the tool in the drawing direction, in accordance with arrow P 1 of FIG. 1, without, however, damaging the underlying wool of fur 16.

In order to obtain a trouble-free placement of sole plate 5 over the entire width of cutter-holder support 1 and against the back side leather, it is preferable if the fur that is to be trim patterned can be clamped with the leather back side arched upwardly, since it is only in this manner that there is a guarantee that all of the knives cut in to the same depth in the back side of the fur.

Figure 7:
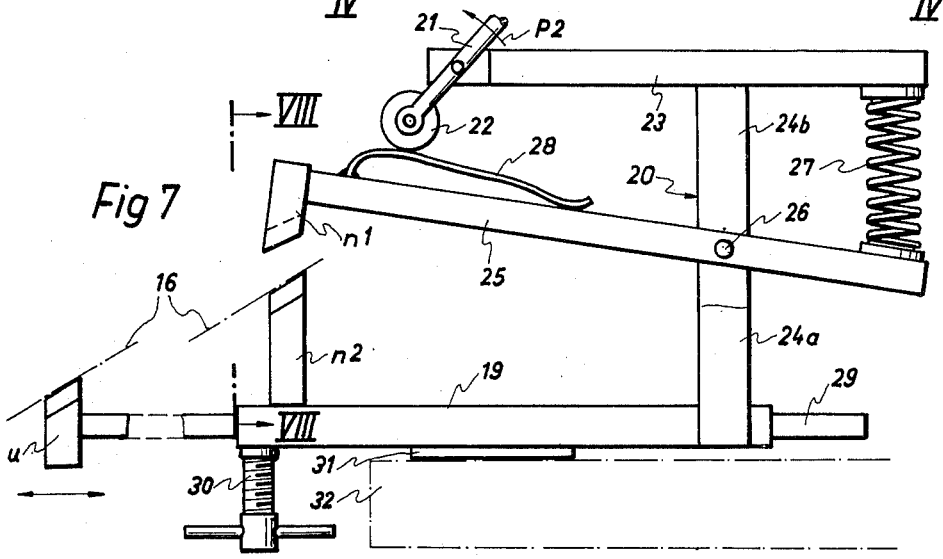
FIG. 7, an example of embodiment for a clamping arrangement for furs and to be used in conjunction with the tool of FIGS. 1–5, in side view as well as in the unclamped, open position.
Figure 5:
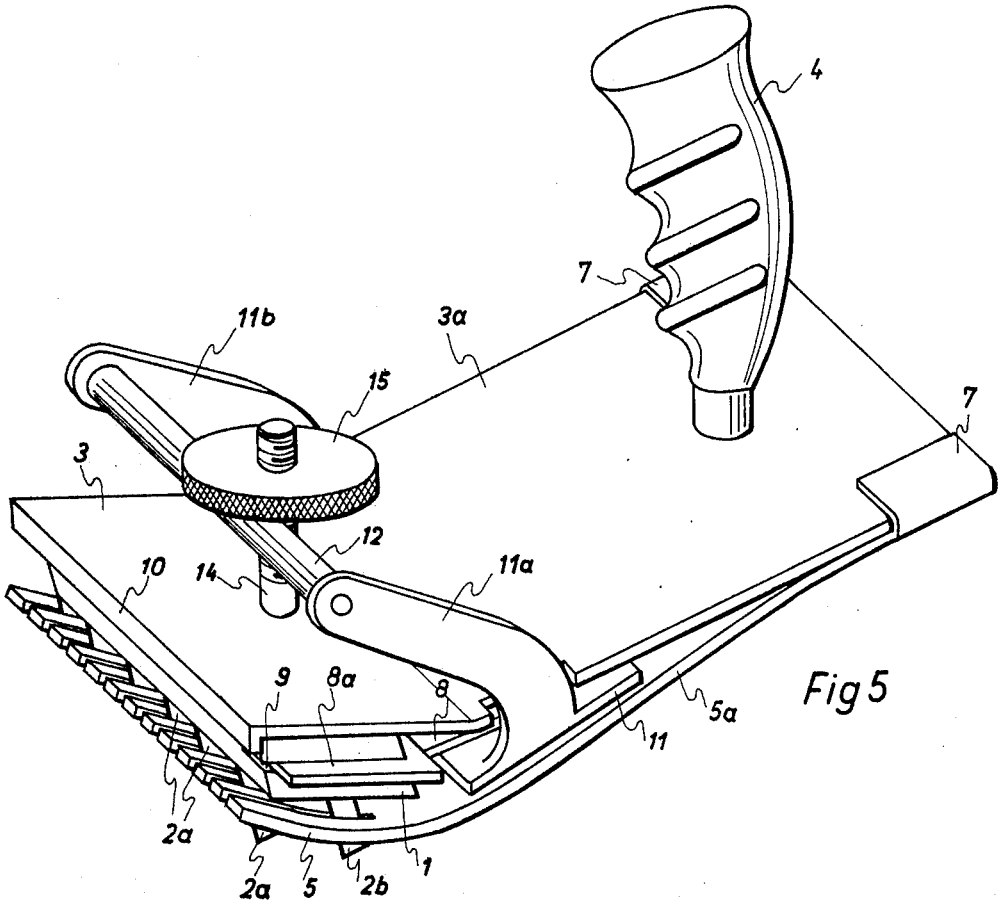
FIG. 5, the tool of FIGS. 1–4 in an overall perspective view seen sidewardly from the top.

A device that is favorable for this purpose is illustrated in FIGS. 7, 8 and includes a pair of clamping jaws

*n*1, *n*2 that are approximately as wide as a fur 16 that is to be trim patterned (represented in FIG. 7 by dash-dot lines and interrupted), wherein the jaw *n*2, which is associated to the fur side, is structured convexly while jaw *n*1, which is associated to the leather back side, is structured concavely. The convex jaw *n*2 is set solidly on the lower horizontal side 19 of a U-like, upright frame 20, whose upper, horizontally running side 23 supports a pivot lever 21 with a feed roller 22 on its free end.

The two sides 19, 23 are connected together through two parallel running intermediate bars 24*a*, 24*b*, on which is linked a pivoting arm 25 through means of a pin 26. On its one side opposite the convex jaw *n*2, pivot arm 25 accepts, rigidly attached, concave jaw *n*1, while a biasing pressure spring 27 reacts on the other end of the pivot arm, which buttresses against an extension of the upper side 23 and seeks to move the concave jaw *n*1 away from the convex *n*2. By pivoting of pivot lever 21 in the direction of an arrow P2, pivot arm 25 along with concave jaw *n*1 can be moved against the convex jaw *n*2 via feed roller 22 which abuts against a leaf spring 28 on the upper side of pivot arm 25, whereby a fur 16 that is to be processed can be clamped between the two jaws *n*1, *n*2.

The lower side 19 of frame 20, in the example of embodiment shown, is structured as a square pipe and serves as a guide for a square pipe 29 of small cross-sectional dimensions, which accepts, firmly attached at its one end, a support chock *u* that is adapted somewhat, in its shape, to the convex jaw *n*2 associated to the side of the fur and directed against it. The required, adjusted interval between the support chock *u* and the jaw *n*2 can be locked by means of a locking screw 30 and is governed by the size of the work piece to be processed. Frame 20 can be fastened to a base plate 32 (represented by dash-dot lines) through means of a base ring 31.

In working with the clamping arrangement of FIGS. 7, 8, the one edge of the fur to be processed is laid on the convex jaw *n*2 and clamped in by swiveling the pivot lever 21 through means of jaw *n*1. Then, after loosening locking screw 30, depending upon the length of the fur 16, the square pipe 29 with support chock *u* is moved far enough away from jaws *n*1, *n*2 as to make the surface of the leather back side that is to be processed accessible to the tool that is in accordance with FIGS. 1–5. Next, locking screw 30 is again tightened. Next, for trim patterning, the fur 16 can be stretched over the support chock *u*, either manually or with the aid of a firmly clamped weight.

We claim:

1. Apparatus for trim patterning furs comprising a group of draw-knife blades arranged on a mounting plate in spaced apart generally aligned parallel relationship at substantially equal intervals adjacent each other, and being arranged with cutting edges extending at an acute angle to the base surface of said mounting plate and including an arcuate plate concave to said mounting plate base surface and having openings formed therein and being normally disposed with the convex surface of said arcuate plate adjacent the material surface to be cut, said openings defining a pass-through opening for each knife blade, and with adjustment means for establishing a desired projecting length for said knife blades over the side of the convex surface of said arcuate plate, the apparatus being characterized in that:

a. said mounting plate having an extension portion and further having a gripping handle thereon;

b. said arcuate plate having an extension portion extending generally upwardly away from the cutting edges of said draw-knife blades with said extension portion being secured to said extension portion of said mounting plate;

c. said arcuate plate extension portion being formed of a resilient material and being normally biased toward said mounting plate;

d. said knife blade adjustment means including means for spreading said arcuate plate away from said mounting plate a certain predetermined distance for simultaneously positioning the cutting edges of said draw-knife blades at a predetermined distance from the convex side of the surface of said arcuate plate, the arrangement being such that a desired projection length of the tips of said draw-knife blades is achieved.

2. The apparatus in accordance with claim 1 being further characterized in that the pass-through openings of said arcuate plate are formed as cutouts extending through the edge of said arcuate plate.

3. Apparatus in accordance with claim 1 being further characterized in that said draw-knife blades are mounted in a support block having a parallelepipedon configuration and wherein said support block is disposed between the inner surface of said mounting plate and the concave inner surface of said arcuate plate.

4. Apparatus in accordance with claim 3 being further characterized in that said mounting plate is fabricated from resilient material.

5. Apparatus in accordance with claim 1 being further characterized in that said spreading means comprises at least one lever arm extending laterally of said mounting plate and which is in engagement with an adjustment screw means secured to said mounting plate.

6. Apparatus in accordance with claim 5 being further characterized in that said mounting plate has an extension portion extending therefrom, and wherein in the space between said support block and the contact area of the extension portion of said mounting plate and arcuate plate there is secured a spring tongue means disposed in alignment with said mounting plate and arcuate plate, the spring tongue means being flexed and normally biased against said mounting plate and receiving said support block at the free end thereof.

7. Apparatus for trim patterning furs comprising a group of draw-knife blades arranged on a mounting plate in spaced apart generally aligned parallel relationship at substantially equal intervals adjacent each other, and being arranged with cutting edges extending at an acute angle to the base surface of said mounting plate and including an arcuate plate concave to said mounting plate base surface and having openings formed therein and being normally disposed with the convex surface of said arcuate plate adjacent the material surface to be cut, said openings defining a pass-through opening for each knife blade, and with adjustment means for establishing a desired projecting length for said knife blades over the side of the convex surface of said arcuate plate, the apparatus being characterized in that:

a. said mounting plate having an extension portion and further having a gripping handle thereon;

b. said arcuate plate having an extension portion extending generally upwardly away from the cutting edges of said draw-knife blades with said extension portion being secured to said extension portion of said mounting plate;

c. said knife blade adjustment means including means for simultaneously positioning the cutting edges of said draw-knife blades relative to the convex side of the surface of said arcuate plate;

d. said pass-through slots of said arcuate plate being formed as cutouts extending through the edge of said arcuate plate;

e. said draw-knife blades being mounted in a support block having a parallelepipedon configuration and wherein said support block is disposed between the inner surface of said mounting plate and the concave inner surface of said arcuate plate;

f. said mounting plate and said arcuate plate extension portions being fabricated from resilient materials;

g. said arcuate plate being resiliently biased toward said support block and said mounting plate, and wherein an adjustable spreader member is interposed between said arcuate plate and said mounting plate for establishing the mutually opposed spacing gap between said mounting plate and said arcuate plate, said spreader member having at least one lever arm extending laterally of said mounting plate and which is in engagement with an adjustment screw means secured to said mounting plate;

h. said support pad and said mounting plate each having extension members extending therefrom and in the zone between said support block and the contact area of the extension portion of said mounting plate and arcuate plate, a spring tongue means is secured in alignment with said mounting plate and arcuate plate and being arranged to receive said support block at the free end thereof, said spring tongue means being flexed and normally biased against said mounting plate, said spring tongue means being structured as a bifurcated fork with two tines arranged to be received in a side take-up slot formed in said support block, and wherein said mounting plate includes a flanged stop restrainably engaging said support block.

8. Apparatus in accordance with claim 7 being further characterized in that said arcuate plate is removably and replaceably joined with said mounting plate.

9. Apparatus in accordance with claim 8 being further characterized in that said arcuate plate at its extension portion end comprises a pair of lateral tabs for gripping engagement of said mounting plate extension portion, said mounting plate extension portion being inwardly tapered adjacent the end thereof in the area of engagement with said lateral tabs.

10. Apparatus in accordance with claim 9 being further characterized in that said gripping handle is secured to said mounting plate extension portion with the axis of said handle extending generally perpendicular to the surface of said mounting plate extension portion.

* * * * *